US009656509B2

(12) United States Patent
Chen

(10) Patent No.: US 9,656,509 B2
(45) Date of Patent: May 23, 2017

(54) PEN

(71) Applicant: Chung-Ping Chen, New Taipei (TW)

(72) Inventor: Chung-Ping Chen, New Taipei (TW)

( * ) Notice: Subject to any disclaimer, the term of this patent is extended or adjusted under 35 U.S.C. 154(b) by 25 days.

(21) Appl. No.: 14/821,751

(22) Filed: Aug. 9, 2015

(65) Prior Publication Data

US 2016/0129723 A1 May 12, 2016

(30) Foreign Application Priority Data

Nov. 7, 2014 (TW) ..... 103219772 U

(51) Int. Cl.
*B43K 29/00* (2006.01)

(52) U.S. Cl.
CPC ..... *B43K 29/00* (2013.01); *B43K 29/004* (2013.01)

(58) Field of Classification Search
CPC ..... B43K 29/00; B43K 29/004
USPC ..... 401/195, 52; 446/330
See application file for complete search history.

(56) References Cited

U.S. PATENT DOCUMENTS 5,927,881 A * 7/1999 Yang ..... B43K 24/163 401/29
6,254,298 B1 * 7/2001 Hsu ..... B43K 29/00 401/195
6,332,727 B1 * 12/2001 Hsu ..... B43K 29/00 401/195
6,688,794 B1 * 2/2004 Hsu ..... B43K 29/00 401/195
6,971,812 B1 * 12/2005 Chen ..... B43K 29/00 401/195
7,213,996 B1 * 5/2007 Chen ..... B43K 29/00 401/195
7,967,463 B2 * 6/2011 Chen ..... B43K 29/10 362/118
2010/0232864 A1 * 9/2010 Lee ..... B43K 24/04 401/99

* cited by examiner

*Primary Examiner* — Jennifer C Chiang
(74) *Attorney, Agent, or Firm* — Pro-TECHTOR International Services; Ian Oglesby

(57) ABSTRACT

The present invention discloses a pen having a swinging decoration. A top end of the pen is installed with an animal-shaped decoration. A mandible and a tail section of the decoration are movable. When a user writes with the pen with a small applied force or the pen is in a standstill state, the mandible and the tail section are at an upper location. When the user writes with the pen with a large applied force, a refill will push an activity rod upward and compress a spring, allowing a tooth row at an upper and lower end of the activity rod to drive a left and right conjugate gear and a gear on the decoration to rotate at a same time, which further enables the mandible and the tail section to swing downward simultaneously.

1 Claim, 5 Drawing Sheets

PEN

BACKGROUND OF THE INVENTION (a) Field of the Invention

The present invention relates to a pen, and more particularly to a pen having a swinging decoration.

(b) Description of the Prior Art

An ordinary pen is only capable of writing. Therefore, some vendor has developed a light pen, where a nib can emit light when the nib is touched; whereas, other vendor has provided a non-illuminating decoration on a pen. However, all the aforementioned pens only have a single function and are not able to provide a dual effect that the decoration will illuminate when the decoration spins or the nib is touched.

SUMMARY OF THE INVENTION

The primary object of the present invention is to provide a pen having a swinging decoration that when a refill of the pen is pressed down with a large applied force, a mandible and a tail section of an animal-shaped decoration on a top end of the pen can be driven to swing downward; whereas, when the applied force is small or the pen stops writing, the mandible and the tail section will be restored upward to their original positions, so as to form a vivid and interesting writing tool.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
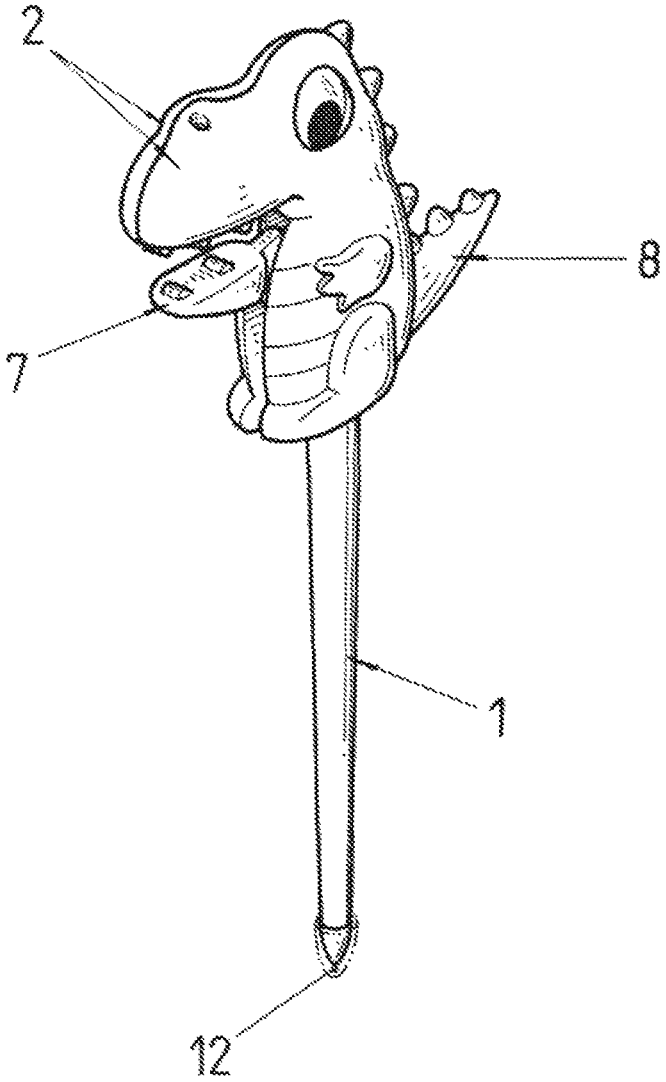
FIG. 1 shows an external view according to the present invention.
Figure 2:
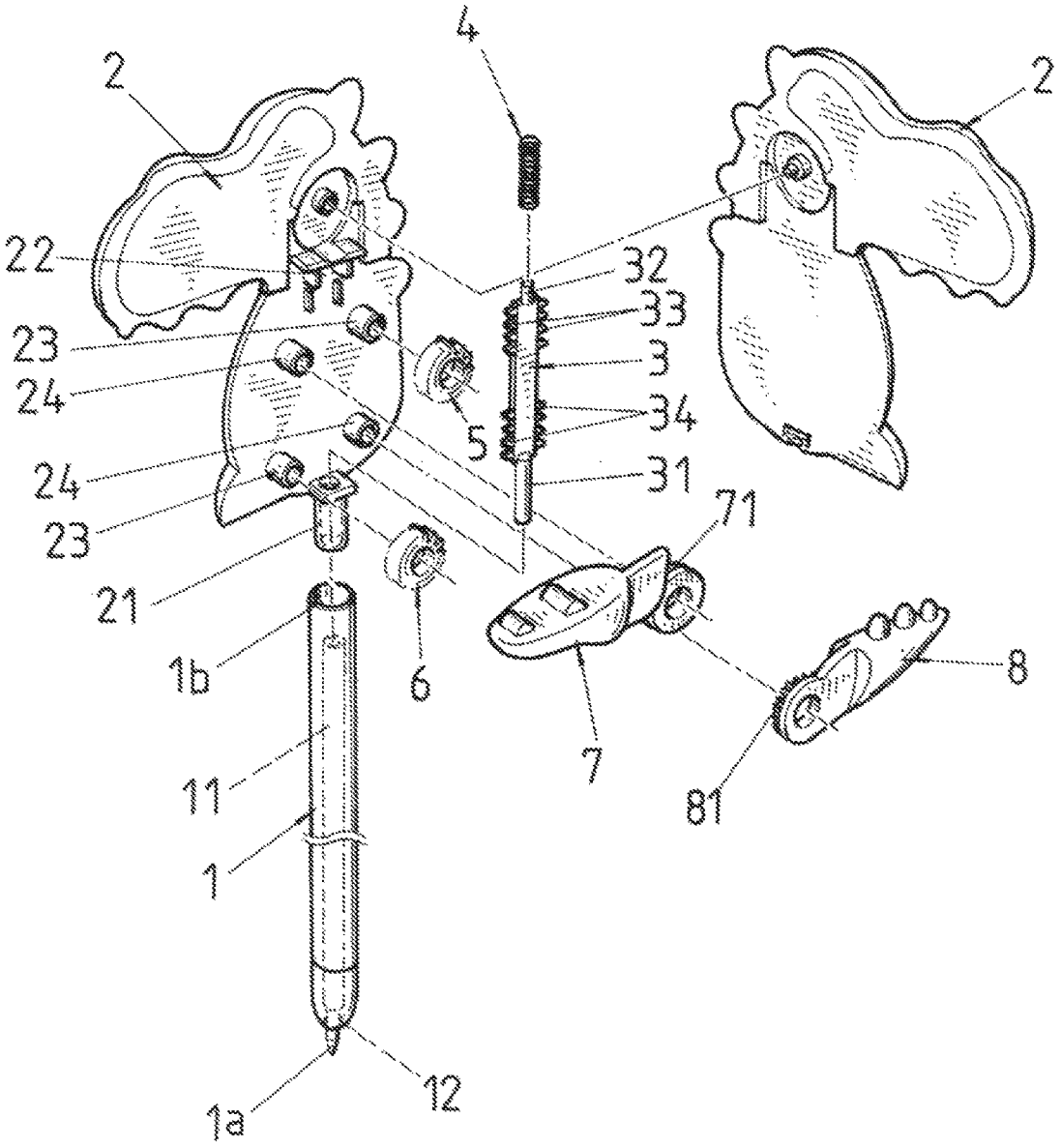
FIG. 2 shows an exploded view according to the present invention.

Please refer to FIG. 1 and FIG. 2 which show that the present invention is structured to comprise a penholder 1, a refill 11, a decoration 2, an activity rod 3, a spring 4, two conjugate gears 5, 6, a mandible 7 and a tail section 8. The penholder 1 is a hollow rod structure, a bottom end of the penholder 1 is provided with a feed hole 1*a* with the aperture which is a little smaller than the inner diameter of the penholder 1, and a top end of the penholder 1 is a through-hole 1*b*.

The refill 11 can be transfixed into the penholder 1 by moving relatively with respect to the penholder 1. A nib 12 of the refill 11 is extended into the feed hole 1*a* of the penholder 1 and is normally protruded out of the penholder 1 for writing.

A spring seat 22 is located at a top end at an interior of the decoration 2, two protruded columns 23, 24 are located at a top end and a bottom end of the decoration 2 respectively, and a hollow tube 21 is located at a bottom end of the decoration 2. The hollow tube 21 is inserted into the through-hole 1*b* of the penholder 1, and an interior at a lower rim of the hollow tube 21 provides for transfixing with the top end of the refill 11. Upon implementing, the said decoration 2 can be formed by combining two animal-shaped slabs.

A protruded pin 32 is located at a top end of the activity rod 3, and two sides at an upper end and a lower end of the activity rod 3 are provided respectively with an upper tooth row 33 and a lower tooth row 34; whereas, an insertion rod 31 at a bottom end of the activity rod 3 is transfixed into an upper rim of the hollow tube 21 of the decoration 2.

An end of the spring 4 is sheathed on the protruded pin 32 of the activity rod 3, and the other end of the spring 4 is abutted in the spring seat 22 of the decoration 2.

The two conjugate gears 5, 6 are alternately sheathed on the protruded columns 23 at the top end and the bottom end of the decoration 2 respectively, and are gnawed with the upper tooth row 33 and the lower tooth row 34 of the activity rod 3 respectively.

A gear 71 at a tail end of the mandible 7 is sheathed on the protruded column 24 opposite to the conjugate gear 5 at the upper end of the decoration 2, and the gear 71 is gnawed with the upper tooth row 33 on the activity rod 3 opposite to a side of the conjugate gear 5.

A gear 81 at a front end of the tail section 8 is sheathed on the protruded column 24 opposite to the conjugate gear 6 at the lower end of the decoration 2, and the gear 81 is gnawed with the lower tooth row 34 on the activity rod 3 opposite to a side of the conjugate gear 6.

Figure 3:
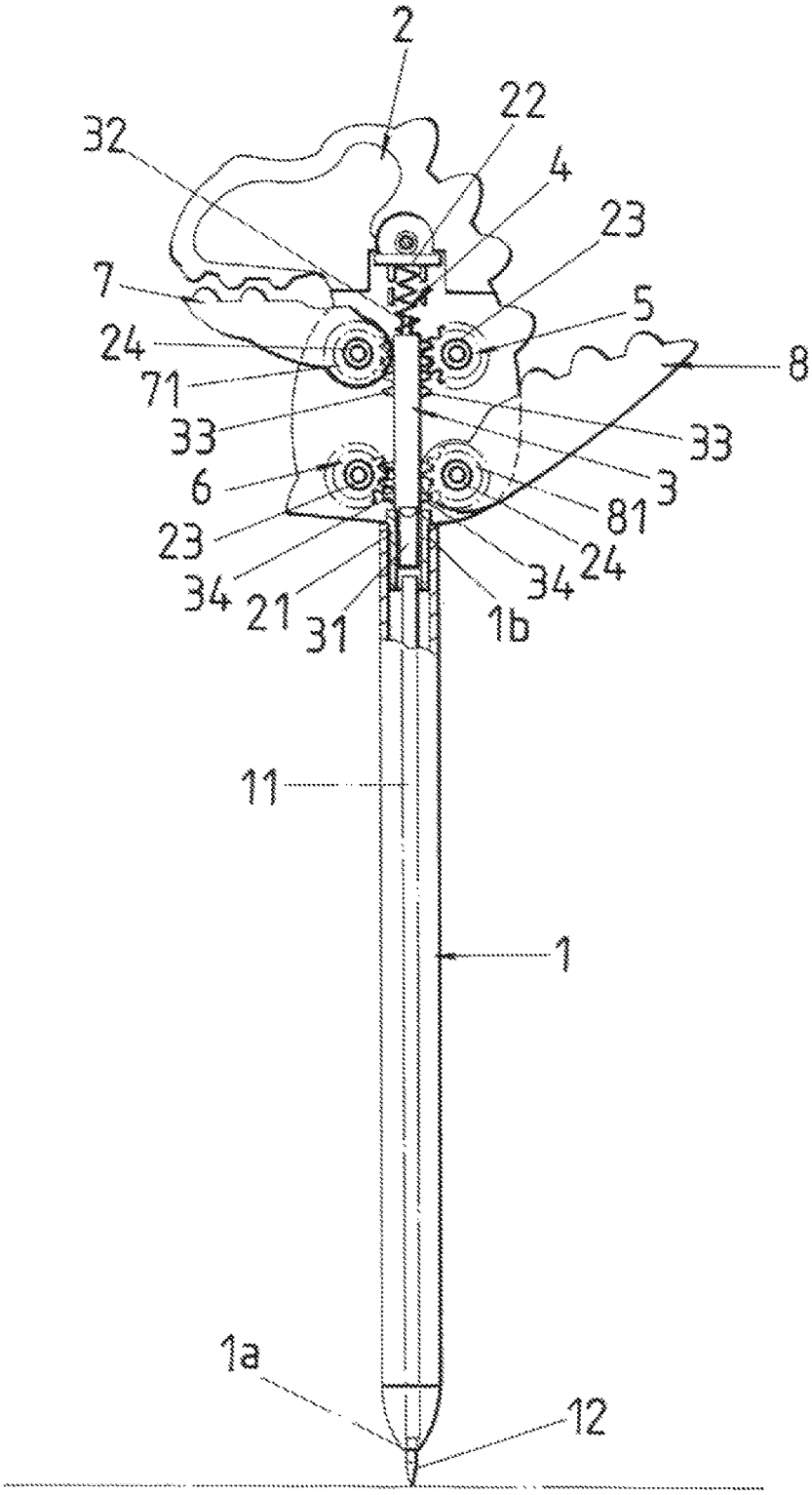
FIG. 3 shows a cross-sectional view of an implementation upon standstill according to the present invention.

In principle, the pen of the present invention can be carried personally for writing. When the pen is in a standstill state (not in use) or a user writes with a small applied force, as shown in FIG. 3, the activity rod 3 will not move and the mandible 7 and the tail section 8 will stay at the top positions of the decoration 2.

Figure 4:
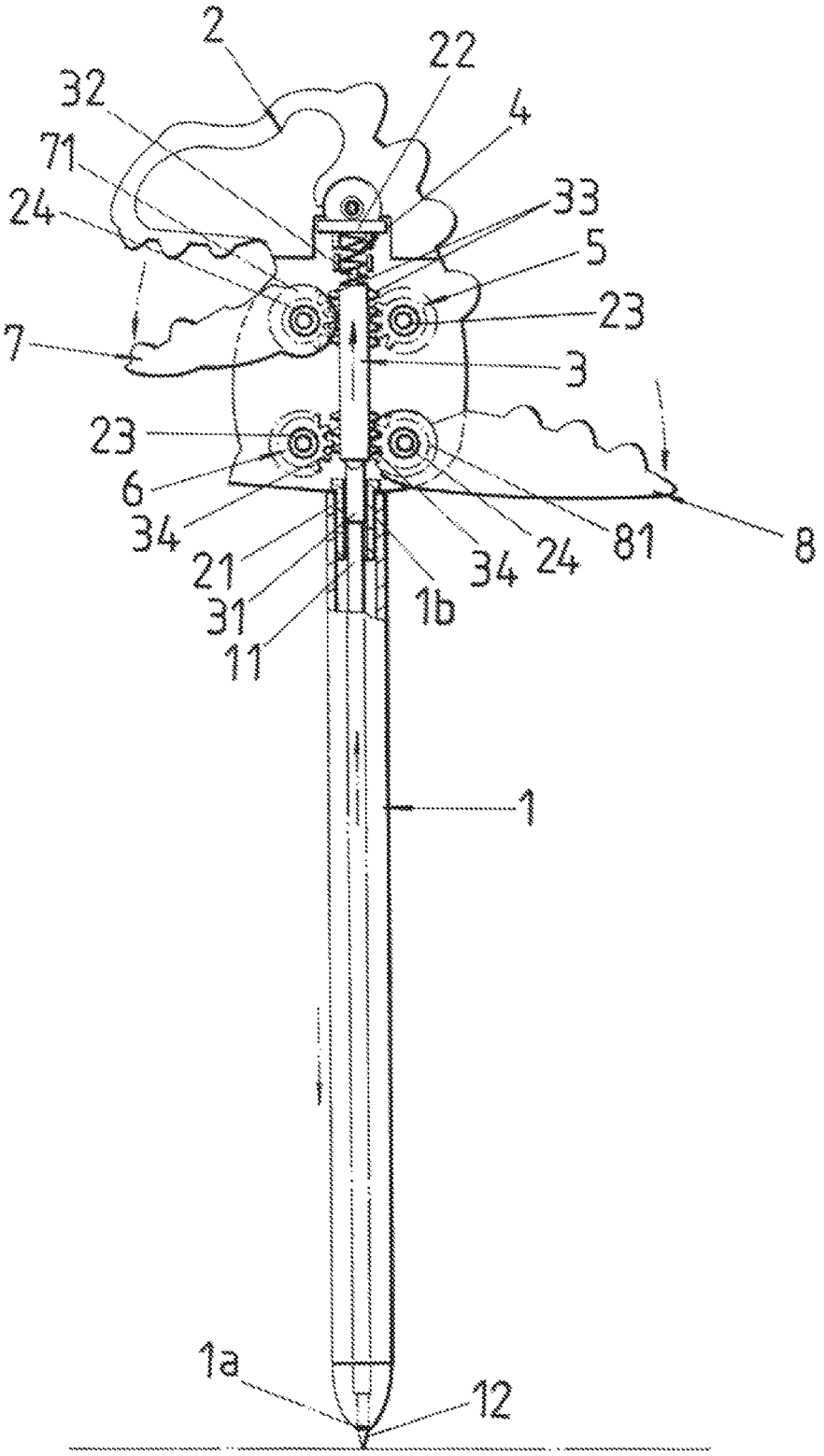
FIG. 4 shows a cross-sectional view of an implementation upon writing according to the present invention.

As shown in FIG. 4, when the user writes with a large applied force, the refill 11 in the penholder 1 will push the insertion rod 31 of the activity rod 3 in the decoration 2 upward, and the activity rod 3 will compress the spring 4 upward. At a same time, the upper and lower tooth row 33, 34 at two sides of the upper and lower end of the activity rod 3 will drive the upper conjugate gear 5 and the gear 71 of the mandible 7, as well as the lower conjugate gear 6 and the gear 81 of the tail section 8 to rotate. Therefore, the mandible 7 and the tail section 8 can swing downward (i.e., the mandible 7 is opened and the tail section 8 is laid down). When the applied force to the refill 11 is small or released (not in use), the restoring force of the spring 4 can push the activity rod 3 downward to its original position, allowing the upper and lower tooth row 33, 34 at two sides of the upper and lower end of the activity rod 3 to drive the conjugate gears 5, 6 and the gears 71, 81 of the mandible 7 and the tail section 8 to rotate reversely, such that the mandible 7 and the tail section 8 can be restored to the state that the mandible 7 is closed and the tail section 8 is lifted up, as shown in FIG. 3.

Figure 5:
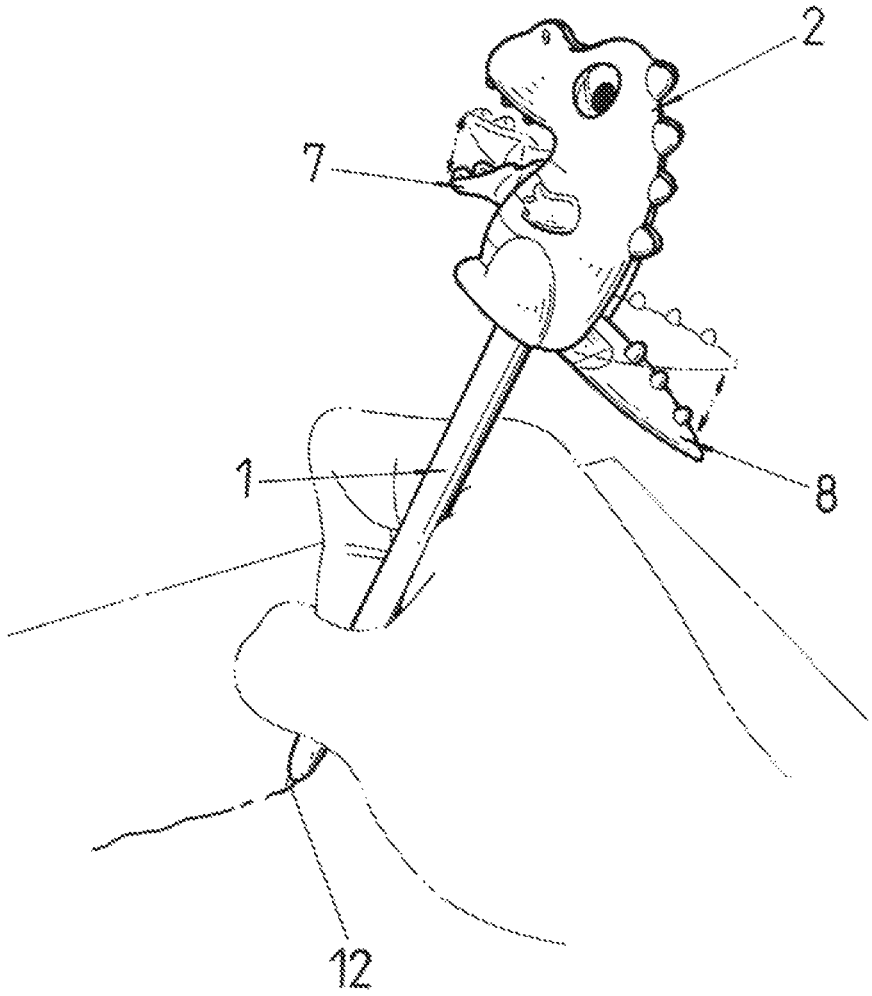
FIG. 5 shows a schematic view of an embodiment upon writing according to the present invention.

As shown in FIG. 5, the present invention relates to a pen having a swinging decoration. The decoration at the top end of the pen can be driven to swing upward and downward upon writing with the pen.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A pen comprising:

a penholder, the penholder being a hollow rod structure, a bottom end of the penholder being provided with a feed hole with the aperture which is a little smaller than the inner diameter of the penholder, and a top end of the penholder being a through-hole;

a refill, the refill being transfixed into the penholder by moving relatively with respect to the penholder, a nib of the refill being extended into the feed hole of the penholder and being normally protruded out of the penholder;

a decoration, a top end at an interior of the decoration being provided with a spring seat, a top and bottom end of the decoration being provided with two protruded columns respectively, the bottom end of the decoration being provided with a hollow tube, the hollow tube being inserted into the through-hole of the penholder, and an interior at a lower rim of the hollow tube providing for transfixing with a top end of the refill;

an activity rod, a top end of the activity rod being provided with a protruded pin, two sides at an upper and lower end of the activity rod being provided respectively with an upper tooth row and a lower tooth row, and an insertion rod at a bottom end of the activity rod being transfixed into an upper rim of the hollow tube of the decoration;

a spring, an end of the spring being sheathed on the protruded pin of the activity rod, and the other end of the spring being abutted in the spring seat of the decoration;

two conjugate gears, the two conjugate gears being alternately sheathed on the protruded columns at an upper and lower end of the decoration and being gnawed with the upper and lower tooth row of the activity rod respectively;

a mandible, a gear at a tail end of the mandible being sheathed on the corresponding protruded column opposite to the conjugate gear at an upper end of the decoration and being gnawed with the upper tooth row of the activity rod opposite to a side of the conjugate gear; and a tail section, a gear at a front end of the tail section being sheathed on the corresponding protruded column opposite to the conjugate gear at a lower end of the decoration and being gnawed with the lower tooth row of the activity rod opposite to a side of the conjugate gear.

* * * * *